United States Patent [19]

Borichevsky

[11] 4,230,363

[45] Oct. 28, 1980

[54] CANOPY FOR FURNITURE FRAMES

[75] Inventor: Donald J. Borichevsky, Wells, Vt.

[73] Assignee: The Telescope Folding Furniture Co., Inc., Granville, N.Y.

[21] Appl. No.: 903,114

[22] Filed: May 5, 1978

[51] Int. Cl.[3] ..... A47C 7/10

[52] U.S. Cl. ..... 297/184; 248/225.3 R

[58] Field of Search ..... 297/184, 188, 16, 19, 297/21, 22, 23, 28, 29, 30; 248/214, 219.4, 218.4, 230, 231, 225.3

[56] References Cited

U.S. PATENT DOCUMENTS

| | | | |
|---|---|---|---|
| 2,051,254 | 8/1936 | Haberstump | 297/184 X |
| 2,471,627 | 5/1949 | Kalter | 248/218.4 |
| 2,964,099 | 12/1960 | Panicci | 297/28 X |
| 3,495,868 | 2/1970 | Vanderminden | 297/27 |
| 4,030,691 | 6/1977 | Fleshman | 248/225.3 |

FOREIGN PATENT DOCUMENTS

| | | | |
|---|---|---|---|
| 594730 | 9/1925 | France | 297/184 |
| 183651 | 1/1935 | Switzerland | 297/184 |

*Primary Examiner*—Roy D. Frazier
*Assistant Examiner*—Peter A. Aschenbrenner
*Attorney, Agent, or Firm*—Kenyon & Kenyon

[57] ABSTRACT

The canopy is mounted on the backrest portion of the furniture frame to pivot into a number of positions to provide shade for an occupant. The canopy may be secured to the furniture frame via a clamp means without any need to modify the furniture frame.

7 Claims, 8 Drawing Figures

22
24
26
17
20
28
27
33

29'
36
31
29
30
34
32

14

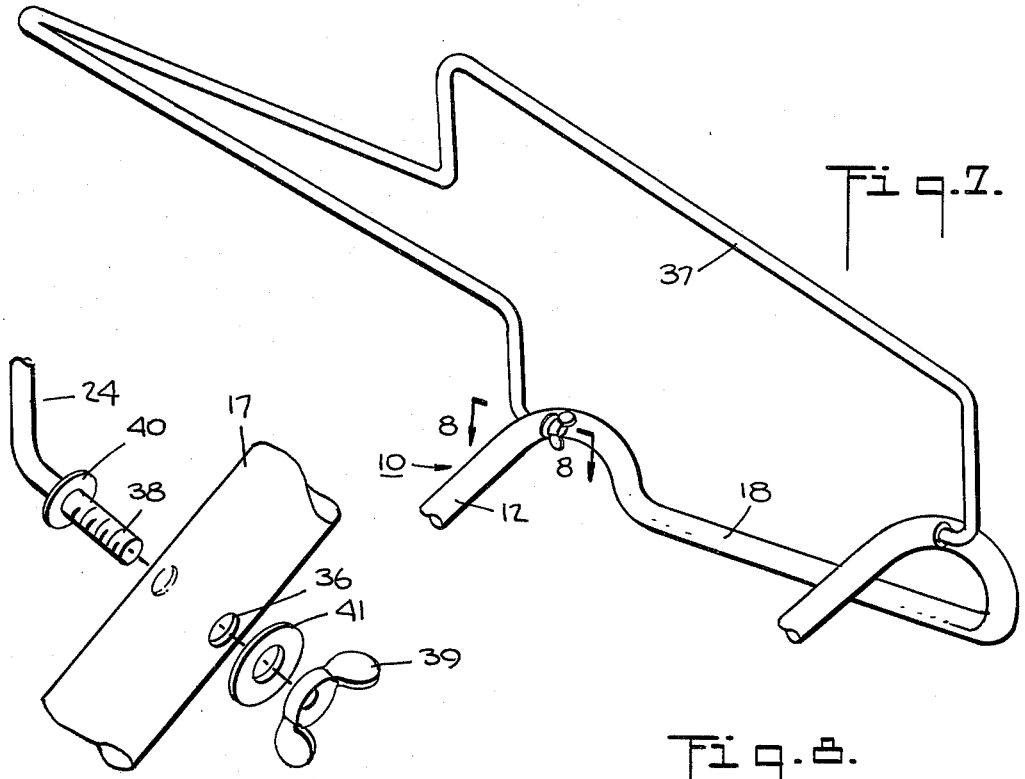
Fig. 7.
Fig. 9.
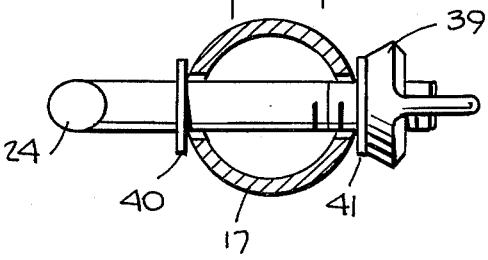
Fig. 8.
Fig. 10.
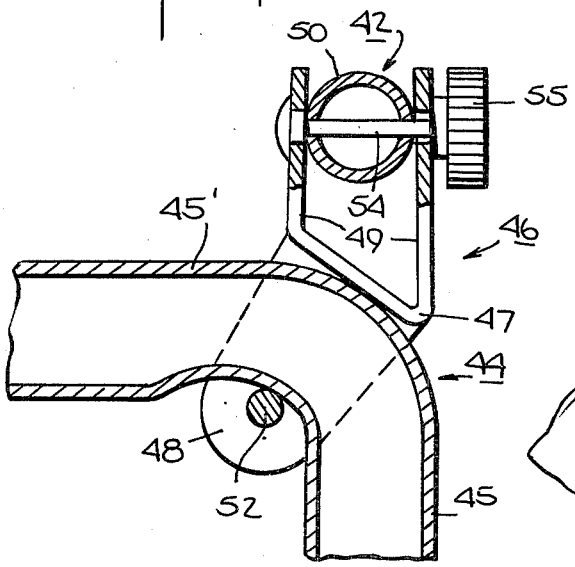
Fig. 11.
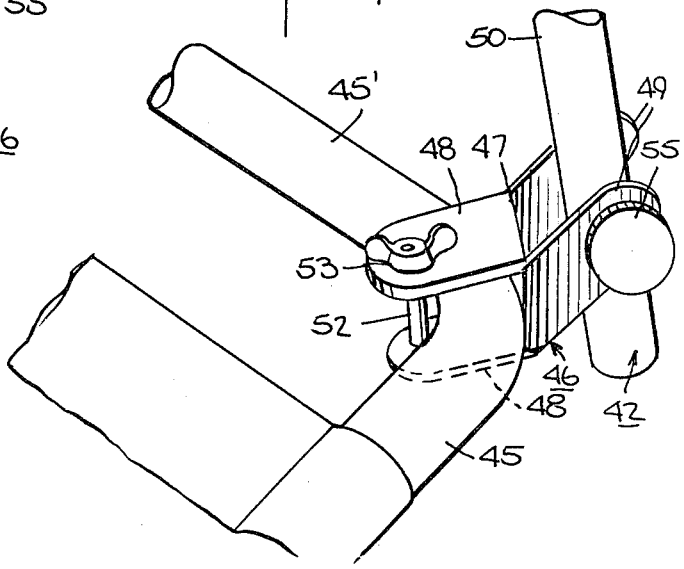

CANOPY FOR FURNITURE FRAMES

This invention relates to a canopy for outdoor furniture. More particularly, this invention relates to a canopy for use on collapsible outdoor furniture frames.

As is known, there are many types of outdoor furniture. In some cases, outdoor furniture is made with frames of rigidly interconnected members while, in other cases, the furniture is made with frames of collapsible construction so as to be folded up for storage and/or transportation. Generally, in either case, the frames are made of tubular construction with suitable materials secured to the frame to form a seat portion and a backrest portion. In some cases, the frames are constructed to form chairs to seat one or more occupants while, in other cases, the frames are constructed to form chaises or lounges.

Generally, when use is made of outdoor furniture in casese where shade is required, particularly at benches and poolside, umbrellas or the like have been positioned adjacent to the furniture frames to provide shade. This, of course, requires a separate stand or support for the umbrella. Further, as the rays of the sun shift during the day, the furniture or umbrella frequently has to be moved to provide the needed shade.

Accordingly, it is an object of the invention to provide an integrated furniture construction which provides shaded comfort for an occupant.

It is another object of the invention to provide a means for shading an occupant of an outdoor furniture without need of an umbrella.

It is another object of the invention to provide a canopy which can be readily mounted on an outdoor furniture frame to provide shading.

Briefly, the invention provides a furniture frame with a canopy. In this regard, the furniture frame may be of the fixed or collapsible type with a backrest portion while the canopy may be constructed with a skeletal frame and a cover which is disposed across the skeletal frame. In addition, means are provided for pivotally mounting the canopy on the backrest portion so that the canopy can move within a range of positions relative to the backrest portion.

In one embodiment, the canopy is constructed so as to be fitted onto existing furniture frames without any need for modifying the existing furniture frame. For example, where the backrest portion of a furniture frame includes a frame having a back support surface and an end portion, the means for mounting the canopy on the furniture frame includes a pair of clamps which envelop the backrest frame and are secured to the ends of the canopy to allow pivoting of the canopy. For a furniture frame having an end portion which terminates in a plane spaced from the plane of the back support surface, as described in U.S. Pat. No. 3,495,868, each clamp is formed of a one-piece plate which envelops the furniture frame in the manner of a strap and has two ends straddling a canopy leg. In addition, a bolt passes through the clamps legs and the canopy leg while a nut is threaded onto the bolt to tighten the plate about the furniture frame while pressing the plate ends against the canopy leg. The clamps which frictionally hold the canopy in place may be provided with additional means to more positively hold the canopy in one of a number of selective positions.

In another embodiment, which is particularly useful with a backrest portion formed by a U-shaped frame having a pair of parallel bars connected by a cross-bar, each clamp includes a one piece plate which has a first pair of parallel legs fitted over the backrest portion and a second pair of parallel legs fitted about a respective leg of the canopy frame. In addition, means are provided for tightening the respective pairs of legs against the respective frames to secure the canopy in a selected position.

These and other subjects and advantages of the invention will become more apparent from the following detailed description taken in conjunction with the accompanying drawings in which:

FIG. 7 illustrates another modified embodiment of a means for mounting a canopy on a furniture frame; and FIG. 8 illustrates a view of the clamp of FIG. 7 relative to a canopy and furniture frame.

Figure 1:
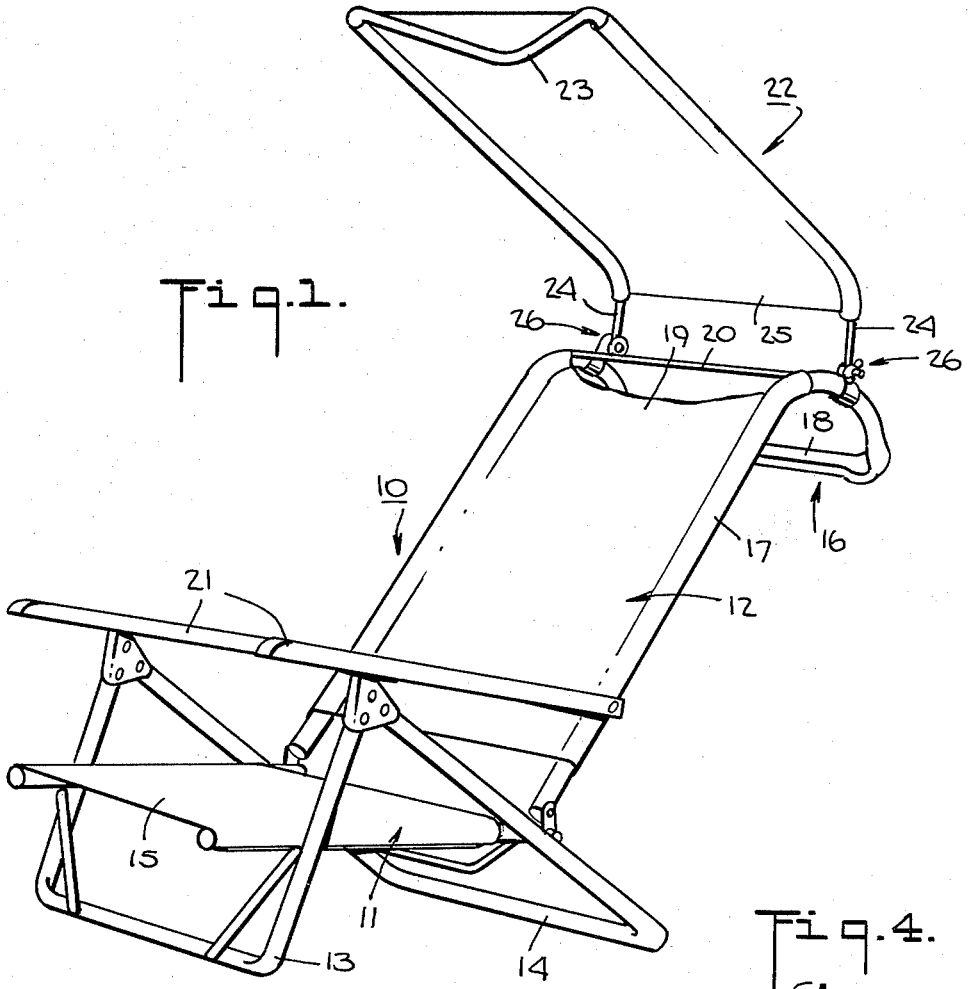
FIG. 1 illustrates a perspective view of an outdoor furniture chain frame having a canopy mounted thereon in accordance with the invention.

Referring to FIG. 1, the furniture frame 10 is in the form of a chair for outdoor use and is constructed in a manner similar to that as described in U.S. Pat. No. 3,495,868. To this end, the chair 10 includes a seat portion 11 and a backrest portion 12 which are articulated together so as to be collapsible towards each other into a generally flattened configuration when not in use. The seat portion 11 has a pair of leg assemblies 13, 14, each of which is constructed of a pair of U-shaped frames and a seat frame 15 to receive an occupant. The backrest portion 12 has a frame 16 which is generally of a U-shape in front view of an inverted J-shape in profile. That is, the frame 16 has a pair of spaced parallel members or bars 17 pivotally connected to the seat frame 15 and a cross-bar 18 which connects the ends of the members 17. The members 17 have straight portion extending away from the points of connection to the seat frame 15 and curved or bent portions at the outermost ends, e.g. the curved portions are in the shape of a ram's horn. In addition, the backrest portion 12 has a strip of back-supporting material 19 secured in known manner between the straight portions of the members 17. Due to the curvature of the ends of the members 17, the cross-bar 18 of the frame 16 is spaced out of the plane of the straight portions of the members 17 and the strip of back supporting material 19.

A hollow stiffening rod 20 is also secured between the members 17 within the curved end portions and out of the plane of the straight portions in order to resist bending or buckling of the members 17. The chair 10 also has a pair of armrests 21 which are secured between the seat portion 11 and the backrest portion 12 in known manner.

A canopy 22 is secured to the top of the chair frame 10 to provide shade for an occupant. To this end, the canopy 22 is formed of a skeletal frame 23 having a pair of parallel hollow legs 24 and a cover 25 which is disposed across the skeletal frame 23. The frame 23 is of M-shape so as to impart a degree of tension in the legs 24 and thus keep the cover 25 taut with a smooth appearance. Further, the legs 24 may be bent as viewed from the side to conform with the bend in the backrest portion 12. Also, the cover 25 may be made with fringe on the outside.

Figure 5:
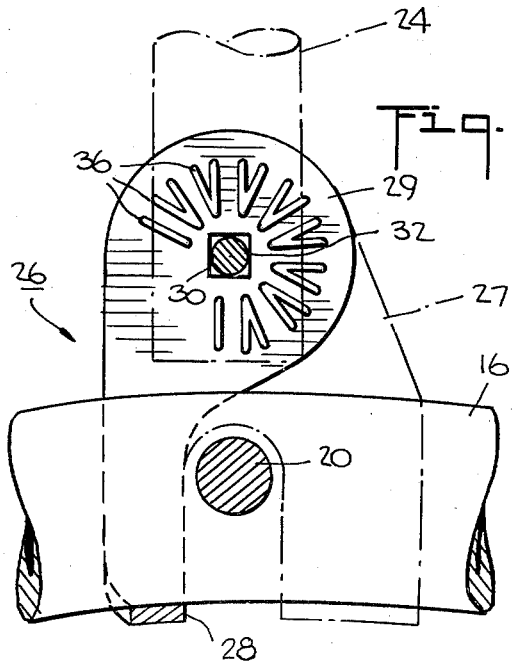
FIG. 5 illustrates a view taken on line 5—5 of FIG. 4.
Figure 4:
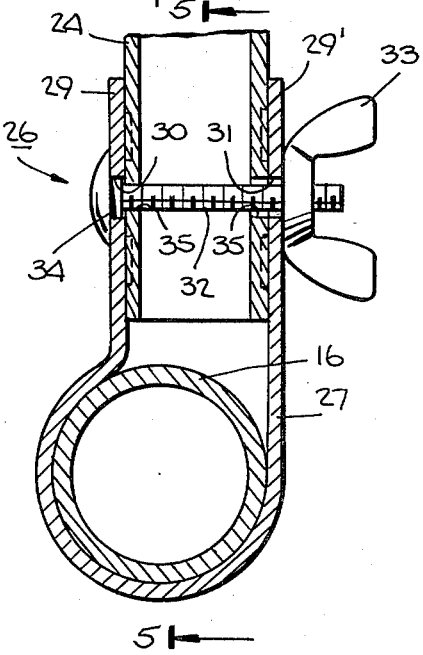
FIG. 4 illustrates a cross sectional view of the mounting means in place.
Figures 2, 3, 6:
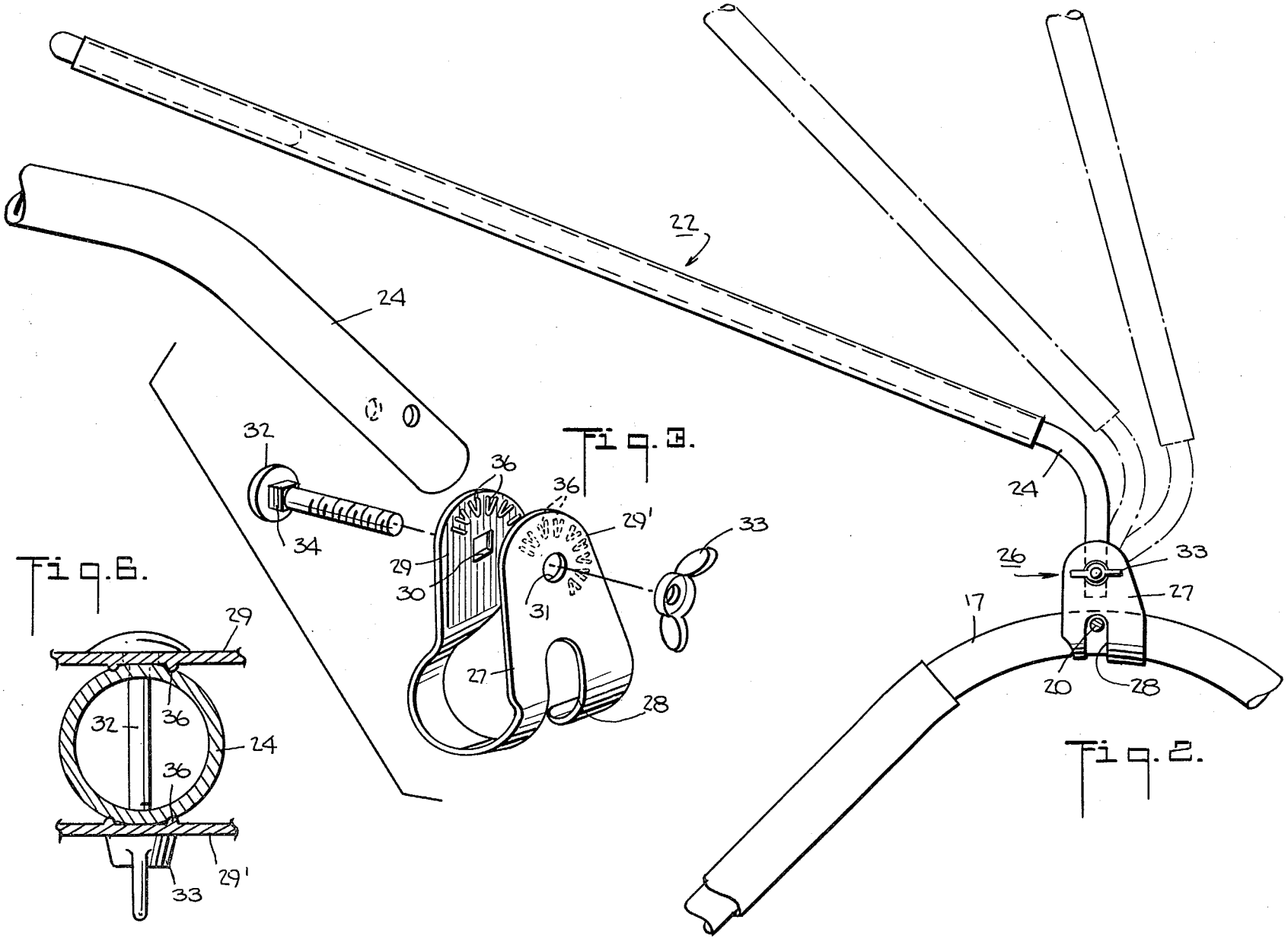
FIG. 2 illustrates an enlarged side view detail of a means for mounting a canopy on the furniture frame of FIG. 1 in accordance with the invention.
FIG. 3 illustrates an exploded view of a mounting means according to the invention.
FIG. 6 illustrates a further view of the mounting arrangement between a canopy leg and the clamp in accordance with the invention.

In addition, means are provided for pivotally mounting the canopy 22 to the end portion of the chair frame 10. To this end, the mounting means includes a pair of clamps 26 which are fitted to the sides of the frame 10. As shown in FIGS. 3 and 5, each clamp 26 includes a one-piece plate 27, e.g. of sheet metal, which is disposed about a respective curved portion of the backrest portion 12. The plate 27 has a slot 28 which receives the stiffening rod 20 such that the rod 20 serves to locate the plate 27 on the backrest portion 12. In addition, the two ends 29, 29' of the plate 27 are rounded and are substantially coextensive with each other. One end is provided with a shaped aperture 30, e.g. of square shape while the other end 28' has an aligned aperture 31, e.g. of round shape. Each clamp 26 also has a bolt 32 and a means, for example, a wing nut 33, threaded onto the bolt 32 to tighten the plate ends 29, 29' about the frame 10 and against a canopy leg 24. The bolt 32 also includes a shaped surface 34 which seats in the shaped aperture 30 to prevent rotation of the bolt 32. As shown in FIGS. 3 and 4, each canopy leg 24 is provided with a pair of aligned apertures 35 to permit passage of the bolt 32.

In order to facilitate the clamping of the canopy leg 24 between the ends of the plate 27, the plate ends 29, 29' may each be knurled with a suitable knurling 36 on a side facing the canopy leg 24 (see FIG. 6). This knurling 36 may be disposed about an arc of 200°.

As shown in FIG. 2, the canopy can be pivoted about 200° from a storage position which is parallel to and in front of the backrest portion 12 or to a position extending substantially vertically upwardly from the backrest portion 12. The rearward motion of the canopy 22 is limited by the abutment of the canopy legs 24 against the bent portions of the members 17 of the chair frame 10 since the legs 21 are located in the same vertical plane as the members 17.

When in use, the canopy can be manually moved into any position required between the two extremes. To this end, the wing nuts 33 may be loosened slightly in order to permit movement of the canopy 22 and thereafter tightened to fix the canopy 22 and the clamps 26 may be such as to permit manual adjustment of the canopy 22.

In order to mount the canopy 22 on an existing furniture frame 10, each clamp plate 27 is fitted about the respective members 17 of a backrest portion 12 and located about the stiffening rod 20. Thereafter, with the canopy legs 24 fitted between the ends 29, 29' of the respective clamp plates 27, the bolts 32 are passed through the apertures 30, 31 in the plate ends 29, 29' and the canopy leg 24. Next, the wing nuts 33 are threaded onto the bolts 32 and tightened against the plate ends 29' to frictionally lock the canopy 22 in place. The position of the canopy 22 relative to the chair 10 can then be adjusted manually. For purposes of storage or transportation, the canopy 22 can be pivoted towards the front of the backrest portion 12.

Referring to FIGS. 7 and 8, a canopy 42 similar to that of FIG. 1 may also be mounted on a collapsible furniture frame 43 having a flat backrest portion 44 constructed in a U-shaped manner of a pair of parallel bars 45 and a cross-bar 45 which interconnects the parallel bars 45. In this case, the mounting means employs a pair of clamps 46, each of which is located at the corner of the frame 43 to frictionally secure the canopy 42 in place. Each clamp 46 includes a one-piece plate 47 which has a first pair of parallel legs 48 receiving the backrest portion 44 and a second pair of parallel legs 49 which receives a leg 50 of the canopy frame 51. In addition, means are provided for tightening each pair of legs 48, 49 about the respective frames 43, 51. As shown, one means includes a bolt 52 which is constructed in similar fashion to the bolt 32 described above and which passes through suitable apertures in the legs 48 (one of which is shaped to receive a shaped surface of the bolt) and a wing nut 53 which is threaded onto the bolt 52. Upon tightening of the nut 53, the bolt 52 brings the legs 48 into frictional engagement with the chair frame 43. The means for tightening the legs 49 against the canopy leg 24, in similar fashion, includes a bolt 54 which passes through the canopy leg 24 as well as the legs 49. This bolt also has a shaped surface to fit into a shaped aperture of one leg 49 and a threaded end to receive a threaded nut or knob 55 for tightening of the legs 49 against the canopy leg 24.

This mounting means permits a relatively easy mounting a canopy onto existing furniture frames. To this end, after securing the clamps 46 to the ends of a canopy, the clamps 46 can be fitted over the corners of an existing furniture frame and clamped thereto via the bolt 52 and nut 53 arrangements.

Instead of using wing nuts in the above embodiments for tightening the various clamps in place, use may be made of threaded knobs.

It is to be noted that the M-shape of the canopy frame eliminates the positioning of a cross-bar in front of the canopy frame. In a chair which is movable into multipositions as described in U.S. Pat. No. 3,495,868, this provides some modicum of safety by lessening the possibility of a user hitting himself in the back of the head or neck when raising the backrest porition from a lay-flat position to a sit-up position. Also, because of the tension provided by the skeletal M-frame, a lightweight magazine may be held between the frame and the cover for temporary storage purposes. The M-frame also imparts a bow and arrow type of tension which imparts a sufficient force in the clamps to prevent slippage of the canopy within the clamps.

The invention thus provides an outdoor furniture frame with an integrated canopy which can be used for shading an occupant. Further, the canopy can be secured to existing outdoor furniture frames of similar construction to those described above without the need for any special tools.

Where the canopy construction is used with a chair as illustrated in FIG. 1, the bent portions of the chair frame prevents the canopy from blowing all the way back in the event the canopy loosens during a heavy wind. An occupant of the chair can then reach up and pull the canopy back easily and can tighten the wing nut 33 or a knurled nut. Further, by folding the canopy against the front of the backrest, the chair can be folded into a compact shape.

The canopy and mounting means illustrated in FIGS. 7 and 8 provides a universal type construction which can be used with any backrest having two square bends. In this embodiment, the canopy is able to fold flat against the front of the backrest to allow a compact folded package to be obtained. Further, the canopy will not blow all the way back in a high or gusty wind as the backrest portion of the furniture frame will act as a stop. In this regard, the legs 50 of the canopy frame 51 extend through the legs 49 of the clamp 46 a distance sufficient to abut against the backrest portion 44 when the canopy is in an upright position substantially parallel to the backrest portion 44.

In the claims:

1. The combination of a collapsible furniture frame having a pivotally mounted back rest portion including a frame having a back support surface and an end portion terminating in a plane spaced from the plane of said back supporting surface, said end portion including a pair of parallel portions, a cross-bar connecting said parallel portions together at the ends thereof and a stiffening rod secured within and to said parallel portions;

a canopy pivotally mounted on said end portion of said furniture frame, said canopy including a skeletal frame having a pair of parallel legs; and means for pivotally mounting said canopy to said end portion, said means including a pair of clamps, each said clamp including a one piece plate disposed about a respective parallel portion of said backrest end portion and having a slot receiving said stiffening rod to locate said plate, a bolt passing through two ends of said plate and a respective one of said canopy legs, and means threaded on said bolt to tighten said plate ends against said respective canopy leg.

2. The combination as set forth in claim 1 wherein said skeletal frame is of M-shape and said canopy includes a cover disposed across said skeletal frame.

3. The combination as set forth in claim 1 wherein each said plate end is knurled on a side facing said respective canopy leg.

4. The combination as set forth in claim 1 wherein said canopy is pivotal about an angle of about 200° from a position parallel to and in front of said back support surface to a position extending from said back support surface.

5. The combination of a collapsible furniture frame having a backrest portion including a pair of parallel bars, a stiffening rod secured between and to said bars and a cross-bar interconnecting said parallel bars, said parallel bars having straight portions and bent portions with said cross-bar interconnecting said bent portins;

a canopy having a skeletal frame including a pair of legs and a cover disposed across said skeletal frame; and means for pivotally mounting said canopy on said backrest portion, said means including a pair of clamps, each said clamp including a one-piece plate disposed about a respective bent portion, a bolt passing through two ends of said plate and a respective one of said canopy legs and means threaded on said bolt to tighten said plate ends against said respective canopy leg, each said plate having a slot receiving said stiffening rod therein.

6. The combination of a collapsible furniture frame having a pivotally mounted backrest portion including a U-shaped frame having a pair of parallel bars and a cross-bar interconnecting said bars;

a canopy having a skeletal frame and a cover disposed across said frame, said frame having a pair of parallel legs; and means for pivotally mounting said canopy on said backrest portion, said means including a pair of clamps, each said clamp including a one-piece plate having a first pair of parallel legs fitted over said U-shaped frame, a second pair of parallel legs fitted over a respective leg of said skeletal frame, first means for tightening said first pair of legs against said U-shaped frame and second means for tightening said second pair of legs against said respective leg of said skeletal frame.

7. The combination of a collapsible furniture frame having a backrest portion including a pair of parallel bars and a cross-bar interconnecting said parallel bars;

a canopy having a skeletal frame and a cover disposed across said skeletal frame; and means for pivotally mounting said canopy on said backrest portion, said means including a pair of clamps, each said clamp including a one piece plate having a first pair of parallel legs receiving said backrest portion therebetween and a second pair of parallel legs receiving said skeletal frame therebetween, first means for tightening said first pair of legs against said backrest portion and second means for tightening said second pair of legs against said skeletal frame.

* * * * *

UNITED STATES PATENT AND TRADEMARK OFFICE

CERTIFICATE OF CORRECTION

PATENT NO. : 4,230,363

DATED : October 28, 1980

INVENTOR(S) : Donald J. Borichevsky

It is certified that error appears in the above—identified patent and that said Letters Patent is hereby corrected as shown below:

Column 1, line 20, change "casese" to --cases--.

Column 1, line 20, change "benches" to --beaches--.

Column 2, line 14, change "chain" to --chair--.

Column 2, line 42, after "view", delete "of" and insert --and--.

Column 4, line 25, after "mounting" insert --of--.

Column 4, line 39, change "porition" to --portion--.

Signed and Sealed this

*Third* Day of *March 1981*

[SEAL]

*Attest:*

RENE D. TEGTMEYER

*Attesting Officer*

*Acting Commissioner of Patents and Trademarks*